US005343658A

United States Patent [19]

McLorg

[11] Patent Number: 5,343,658

[45] Date of Patent: Sep. 6, 1994

[54] AIR SUPPORTED STRUCTURE WITH FUNICULAR CABLE ASSEMBLY

[75] Inventor: Anthony B. McLorg, Lexington, Ky.

[73] Assignee: Fabric Enclosures, Inc., Lexington, Ky.

[21] Appl. No.: 69,961

[22] Filed: May 28, 1993

Related U.S. Application Data

[63] Continuation-in-part of Ser. No. 685,231, Apr. 12, 1991, abandoned.

[51] Int. Cl.[5] ..... E04B 7/08; E04H 15/20

[52] U.S. Cl. ..... 52/2.26; 52/2.24; 52/80.1

[58] Field of Search ..... 52/223.1, 223.13, 223.14, 52/2.11, 2.24, 2.25, 2.26, 83, 63, 80.1, 80.2, 81.1

[56] References Cited

U.S. PATENT DOCUMENTS

| | | | |
|---|---|---|---|
| D. 272,470 | 1/1984 | Thompson . | |
| 4,024,679 | 5/1977 | Rain et al. . | |
| 4,041,653 | 8/1977 | Rain . | |
| 4,550,533 | 11/1985 | Fraioli | 52/2.25 |
| 4,932,169 | 6/1990 | Charbonneau | 52/2.25 |

FOREIGN PATENT DOCUMENTS

| | | | |
|---|---|---|---|
| 962912 | 2/1975 | Canada | 52/2.26 |
| 2522453 | 12/1975 | Fed. Rep. of Germany | 52/2.26 |
| 1309317 | 10/1962 | France | 52/2.26 |
| 1027437 | 4/1966 | United Kingdom | 52/2.26 |

*Primary Examiner*—Michael Safavi
*Attorney, Agent, or Firm*—King & Schickli

[57] ABSTRACT

An air supported structure includes a wall portion formed from a plurality of elongated panel members joined together by seams. Webs are interconnected along the seams to relieve stress. A plurality of header cables carry the loads placed on the structure. The header cables extend between corner support assemblies and a funicular cable assembly. The funicular cable assembly extends in an arcuate path around an apex of the structure. More specifically, the funicular cable assembly includes first and second independent strands. The webs passing through the apex of the structure are alternatively connected to these two cable strands. These same webs extend between and are connected to a ground anchoring structure at one end and a crown harness at the other that extends along the apex. The funicular cable assembly advantageously serves to balance the loads placed on the header cables by, for example, changes in wind speed and direction, so as to significantly enhance the stability of the structure.

14 Claims, 6 Drawing Sheets

AIR SUPPORTED STRUCTURE WITH FUNICULAR CABLE ASSEMBLY

This is a continuation-in-part of application Ser. No. 07/685,231, filed Apr. 12, 1991, now abandoned.

TECHNICAL FIELD

The present invention relates generally to improvements in air supported structures and, more particularly, to an air supported structure including a funicular cable assembly specifically adapted to balance static and wind related loads and stresses so as to significantly improve the stability of the structure.

BACKGROUND OF THE INVENTION

In recent years, there has existed a growing demand for air supported structures of large size as relatively permanent installations. In order to meet the increased demand for such structures, a need has developed to design the structures with long-term structural integrity and weather resistance.

In order to achieve structural integrity, an air supported structure generally must be designed to withstand two primary types of loading. The first is static and uniform loading that is produced by inflation pressure within the air supported structure. This is typically generated from the input of air from one or more blower systems. The systems are adapted to discharge air into the interior of the air supported structure. The second is generally asymmetric loading produced by air flow over the exterior of the structure. This is often referred to as aerodynamic loading. Depending on the wind speed and direction, aerodynamic loading is quite variable. In fact, under certain storm conditions, aerodynamic loading may change significantly in a very short period of time. Such rapid and drastic changes may affect the stability of the structure.

There are, of course, also various other asymmetric load factors to be considered. Heavy snowfall is one example of this type of load factor. However, in the absence of extreme loading from snow or another such asymmetric load factor, an air supported structure designed to withstand expected wind velocities for its location would normally withstand such other load factors. Accordingly, the ability to withstand aerodynamic loading is the key design feature in air supported structures.

Aerodynamic loading varies as the square of the exterior wind velocity and is proportionately much larger than the normal stresses due to inflation pressure alone. Additionally, it should be appreciated that inflation pressure static loading and variable aerodynamic loading are additive. They also almost invariably act in the same direction.

When any non-uniform loading occurs, equilibrium conditions in the air supported structure may only be achieved either by redistribution of the load or by distortion of the structure. Of course, distortion of the structure is undesirable. Hence, it is critically important for the air supported structure to be designed to provide effective redistribution of load factors. The present invention meets this need by providing improved redistribution and load balancing capabilities.

SUMMARY OF THE INVENTION

Accordingly, it is a primary object of the present invention to provide an air supported structure of unique construction providing significantly enhanced stress relief and load balancing capabilities.

Yet another object of the present invention is to provide an air supported structure exhibiting significantly improved stability even in gusty, high wind conditions.

Yet another object of the invention is to provide an air supported structure having an interconnected and/or interrelated cable network particularly adapted for stress relief so as to maintain the air supported structure in a form substantially similar to that of static equilibrium even when being subjected to variable, asymmetrical aerodynamic loading.

An additional object of the present invention is to provide an air supported structure with a funicular cable assembly that extends in an arcuate path with two degrees of curvature around the apex of the structure. The funicular cable assembly serves to redistribute and balance the asymmetrical loading across the structure to significantly enhance stability. Advantageously, a bubble shaped dome is also formed within the funicular cable assembly. This dome serves to collect warm air in the winter. The collected warm air serves to melt any ice and snow on the exterior of the dome.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved air supported structure is provided for anchoring to the ground. The air supported structure includes a wall portion formed from a plurality of panel members joined together by seams. Reinforcements, such as webs or even cables, are interconnected along the seams to relieve stress. A plurality of header cables carry the loads placed on the structure.

A funicular cable assembly extends in an arcuate path around an apex of the structure. The header cables are connected to the funicular cable assembly which acts to distribute loads, particularly variable loads due to wind speed and direction, equally throughout the air supported structure so as to significantly enhance and improve the stability of the structure.

A crown harness is received within the perimeter of the funicular cable assembly. The crown harness extends along the apex which takes the shape of a bubble dome. This bubble dome advantageously collects and holds heat in the winter. This heat is effectively transferred through the panel members of the wall portion forming the bubble dome apex to any snow collecting on the dome. This causes the snow to melt and slide down the steep slopes of the bubble dome and then on down the wall portion thereby relieving this weight from the structure and preventing pooling or puddling; that is, low spots or depressions in the wall of the structure that collect and hold water.

The air supported structure also includes means for anchoring the structure to the ground. This may include a concrete footing or foundation within which may be countersunk or otherwise attached spaced connecting elements to which the webs are attached.

More particularly, the funicular cable assembly is described in the force diagrams, FIGS. 7 and 9. In the force diagrams the funicular assembly is represented as a single strand with an imaginary centerline. In practice, for ease of construction, the funicular assembly may include first and second cable strands forming respective inner and outer funicular polygon rings around the bubble dome apex. Means are also provided for connecting the reinforcing webs to the first and second cable strands. More particularly, adjacent webs are alternately connected to the first strand and the second strand around the entire periphery of the funicular cable assembly. The webs connected to the first and second strands also extend between and are connected to the anchoring means and the crown harness at the respective ends thereof.

The air supported structure further includes a corner support assembly at each corner of the structure. The plurality of header cables are each connected at one end to one of the corner support assemblies and at the other end to the funicular cable assembly. Each corner support assembly includes a corner fan plate and a radially arranged series of webs extending about an arc of, for example, between 36° and 120° depending upon the number of sides to be included in the air supported structure.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
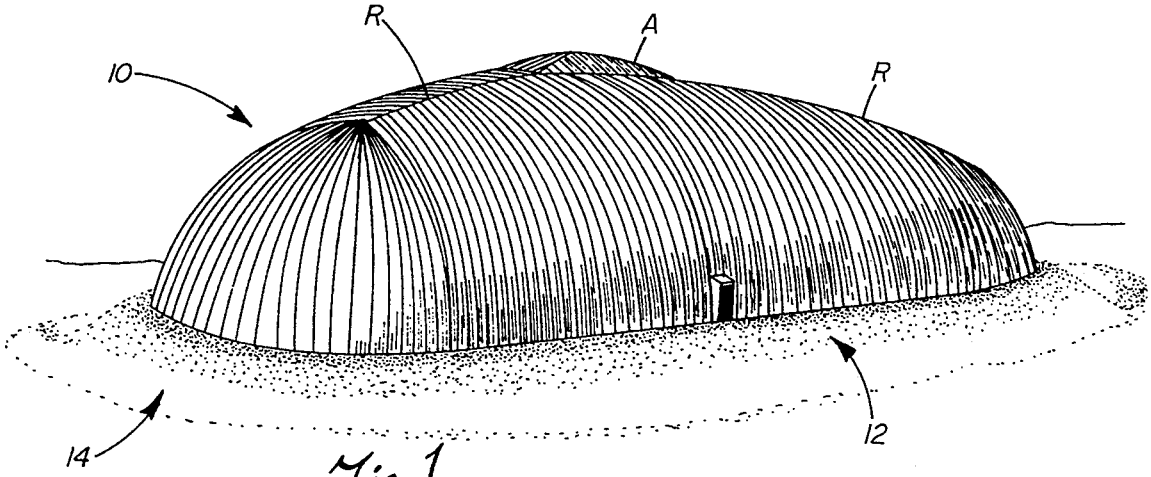
FIG. 1 is a perspective view of an equilateral triangular shaped air supported structure constructed in accordance with the teachings of the present invention.
Figure 2:
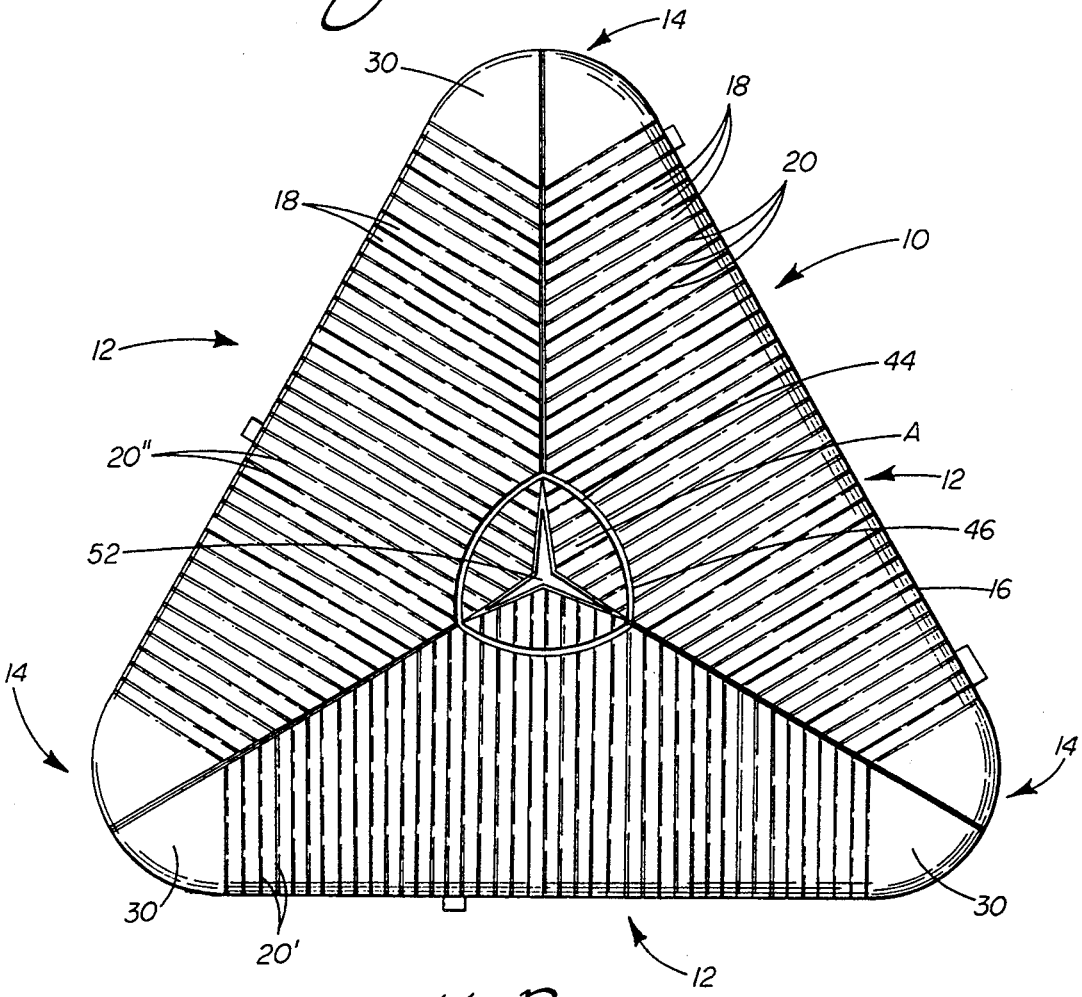
FIG. 2 is a top plan view of the air supported structure shown in FIG. 1.

Reference is now made to FIGS. 1 and 2 showing an air supported structure 10 constructed in accordance with the teachings of the present invention. As shown, the air supported structure 10 includes three sides 12 and three corners 14. It should be recognized, however, that the three-sided structure shown is merely exemplary of an air supported structure 10 of the present invention and the invention is not to be limited thereto. In fact, the concepts of the present invention may be utilized to construct air supported structures including any number of sides as may be desired depending upon the particular application or purpose for which the structure is to be utilized.

The structure 10 includes a wall portion 16 that comprises a plurality of panel members 18. The panel members 18 may be interconnected by seams. Reinforcing webs 20 are provided along the seams. The webs 20 serve to relieve stress along the seams.

Figure 4:
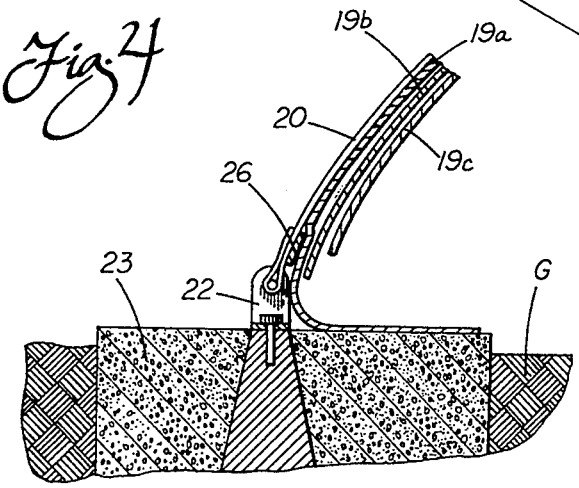
FIG. 4 is an enlarged fragmentary sectional view showing a trimembrane panel configuration and a ground anchoring system.
Figure 5:
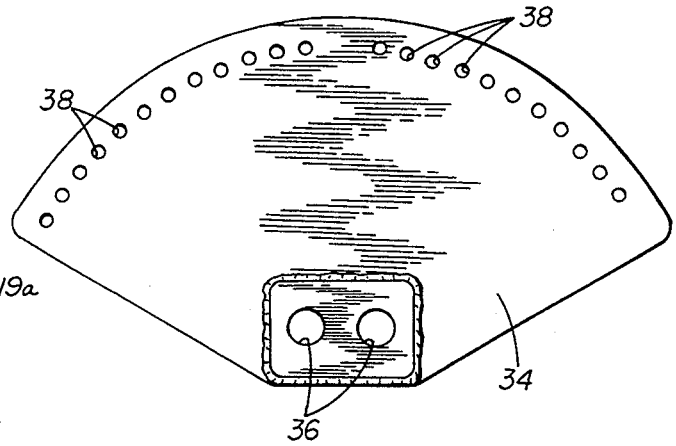
FIG. 5 is a detailed view of a corner plate that is part of each corner support assembly of the air supported structure of the present invention.
Figure 6:
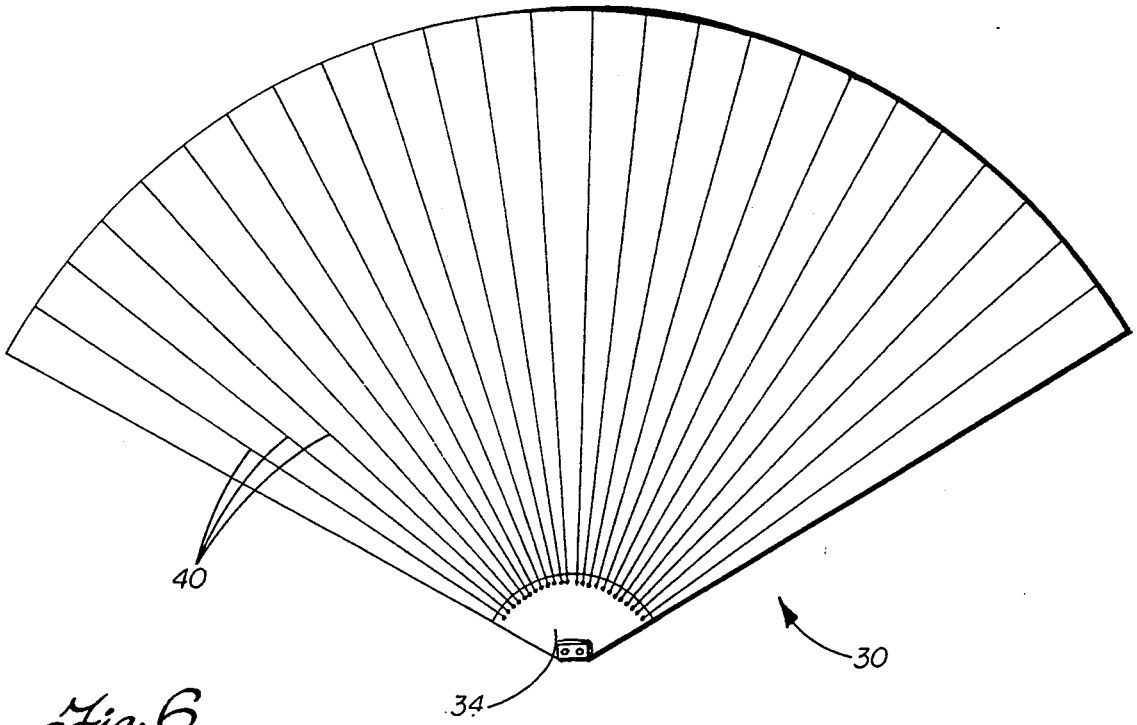
FIG. 6 is a detailed schematical view of a corner support assembly.

More particularly, the panel members 18 may be of any desired membrane configuration including single and multiple membrane configurations (note the three membrane configuration shown in FIG. 4 including membranes 19*a*, 19*b* and 19*c* with intervening air spaces). Various acceptable membrane configurations are shown in, for example, U.S. Pat. No. 4,024,679, the full disclosure of which is incorporated herein by reference. Preferably, each panel member 18 includes at least one membrane formed from woven polyester cloth that is UV stabilized and coated with polyvinylchloride.

The panel members 18 of the wall portion 16 are preferably configured to provide an exterior volute surface. As is known in the art, the surface may include an exterior lamination of "TEDLAR" which is a low friction non-stick material developed by DuPont de Nemours. Advantageously, such a coating serves to maintain a clean smooth surface. This not only aids in providing an aesthetically pleasing clean surface but also in furnishing smooth air flow as well as enhanced water and snow shedding action.

The seams between the panel members 18 may be formed by an interlocking folding together of the side edges of the membrane configurations of adjoining panel members 18. Thus, as is known in the art, each seam may include a given running width of each membrane configuration of adjoining and interconnected panel members with each seam having a given cross-sectional area and a given modulus of elasticity. The webs 20 are preferably interconnected along each seam such as by double stitching rows in a manner known in the art. The webs 20 advantageously serve to relieve the stress of the seams and provide for resolution of stress from the membrane configuration of the panel members 18. Preferably, the webs 20 are formed from UV stabilized polyester material including, for example, a two-ply material with a strength rating of 14,700 pounds.

As best shown in FIGS. 2 and 4, some of the webs 20, such as shown at 20', are attached at one end to anchors such as a bifurcated connecting element 22 about which may be looped the lower most end of the webs. As should be appreciated, the connecting element 22 may be countersunk or otherwise attached to a concrete slab or footing 23 that securely anchors the air supported structure 10 to the ground G. The other end is connected to a header cable assembly 28 or a corner plate 34, both described in greater detail below.

Figure 3:
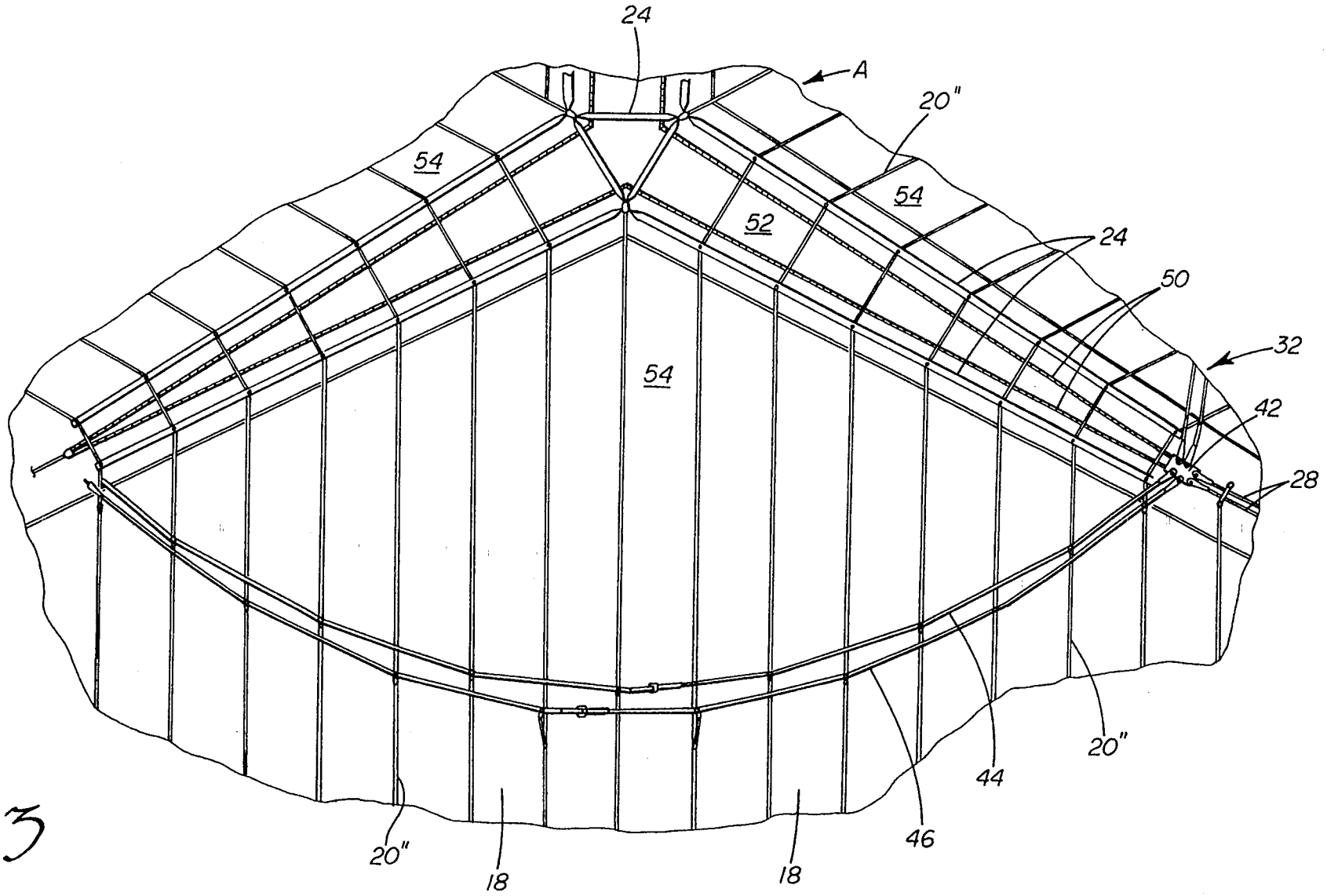
FIG. 3 is a detailed view showing one segment of the funicular cable assembly of the present invention.

Others of the webs 20 such as shown at 20" in FIG. 2 are attached at one end to a bifurcated connecting element 22, intermediately to a funicular cable assembly 32 and at the other end thereof to a crown harness means 24 (see also FIG. 3). As is known in the art, a reinforcing web 26 may also be attached transversely across the panel members 18 adjacent the ground line for strengthening the panel members 18 adjacent the point of interconnection of the webs 20 to the bifurcated connecting elements 22.

A plurality of header cables 28 are provided for carrying and distributing loads placed on the structure 10. Two, parallel header cables 28 are positioned so as to extend along each ridge R running between a corner support assembly 30 and a funicular cable assembly 32. Each corner support assembly 30 includes a corner fan plate 34 such as shown in FIG. 4. Each corner plate 34 includes two central openings 36. One header cable 28 may be attached to each opening 36 by means of a shackle or other known connecting member (not shown). Radially arrayed across the opposite end of the corner fan plate 34 is a series of secondary apertures 38. Depending upon the shape of the air structure 10, the apertures 38 may be radially arrayed across an arc ranging from, for example, 36° for a ten sided structure to 120° for a three sided structure as shown. A series of reinforced corner webs 40 are connected in each of the apertures 38 by means of a shackle or other known connecting member (not shown). The opposite ends of the reinforced webs 40 are connected to bifurcated connecting elements 22 held in the concrete footing 23 (see FIG. 4).

As best shown in FIG. 3, the opposite ends of the header cables 28 may be connected by a shackle or other appropriate means to a six-point plate 42. The six-point plate 42 is also connected to the funicular cable assembly 32.

The funicular cable assembly 32 includes two cable strands 44, 46. The first strand 44 forms an inner funicular polygon loop about the apex A of the structure 10. The second strand 46 forms a similar but outer funicular polygon loop about the apex A.

As shown in FIG. 3, each web 20" passing through the apex A is shackled to a cable clip carried on one of the two cable strands 44, 46 of the funicular cable assembly 32. More particularly, adjacent webs 20" are alternately connected to the first or inner strand 44 and the second or outer strand 46 all the way around the apex A. Additionally, each web 20" is connected to the crown harness 24 by any means known in the art. A clamp line 50 is also provided extending in a three-point star shape across the apex A. This clamp line 50 serves to connect the central three-point star shaped panel section 52 to the three side wall sections shown as 54 in FIG. 3.

The air support structure 10 of the present invention provides a number of unique advantages. As best appreciated from viewing FIGS. 1 and 2, the apex A of the structure 10 is defined by the funicular cable assembly 32. The apex A is in the form of a bubble dome that serves to collect the warmest air which rises up inside the structure 10. By constructing the centrally located three-star panel 52 from a single, thin membrane, it is possible to provide efficient transfer of heat from the bubble dome apex A through to the exterior of the structure 10. This is particularly useful in the winter as the heat transferred melts snow and ice in the area of the apex A. The steep slope of the side of the apex A causes the snow to slide from the apex down along the side panels 54 sweeping snow and ice from them as it slides down. This snow shedding action advantageously serves to reduce structural loading that might otherwise lead to pooling or puddling at the top of the dome. Of course, not only does pooling and puddling lead to shape distortions, but in severe cases it can cause structural damage. Advantageously, this problem is significantly reduced and in most instances avoided with the present design.

The bubble dome form of the apex A is a contour variation that also acts to disrupt laminar air flow. This disruption reduces air foil suction effects that create significant lifting forces upon prior art air supported structures. As a result, wind deflections are reduced and stability is enhanced.

It should also be recognized that the present construction of the structure 10 serves to provide a reactive equilibrium or load sharing system. More particularly, the funicular cable assembly 32 reacts to variable loading due to changes in wind direction and force. In effect, a self-correcting resilient system is provided that counterbalances the load for better equilibrium, strength and stability. As such, the air structure 10 of the present invention can withstand more extreme wind conditions than prior art air structures. This improved durability increases the potential commercial uses for this type of structure.

Additionally, the geometry that results from the utilization of the funicular cable assembly 32 in conjunction with the connection of that assembly to the webs 20" and header cables 28 provides a structure 10 with relatively vertical side walls. By having more vertically oriented side walls than air structures of the prior art, particularly in the area adjacent the ground, the air structure 10 of the present invention provides more useful space. This is particularly true along the wall margins within the perimeter of the structure.

When designing and building the structure 10 of the present invention, it is important to note that the shaping and sizing of the funicular cable assembly 32 is important in order to balance the loads and maintain the six-point plates 42 in equilibrium. More particularly, the depth of the arcuate portions of the individual cable strands 44 and 46 is important.

The funicular cable assembly 32 may be designed in any number of ways known in the art including modeling the loads that will act on the structure 10. More particularly, the objective of modeling is to establish an equilibrium condition between the stiff, terminal legs of the system (i.e. the corner fan plates 34 of the spherotic corner assemblies 30 as joined to the cables 28 on the diagonal junction of the parallel panel sections) and the resilient, curved central funicular cable assembly 32. Because the depth of curvature in the funicular cable assembly 32 is load dependent, balancing the loads in the assembly and legs is necessary to pattern the canopy and to properly locate the junction between the cable strands 44, 46 and the webbing reinforcements 20''.

One method of modeling for equilibrium includes a step of establishing the panel and reinforcement frequency of the side wall panels and base of the panels of the corner support assemblies 30. The frequency is then keyed to the intended plan of the structure with optimized symmetry. The volume of the structure is then modeled for continuity of curvature as a simple form without the bubble dome apex. The volumetric model allows the determination of the radius of curvature for each panel in both the side wall and corner support assembly sections 30. The radius and intended operating pressure are then used with the equations PR=S for the side walls or PR/2=S for the corner panel assemblies 30 to determine the stress levels for the selected panel frequencies.

Next is the steps of summing the loads in the header cables 28 that will act against a given section of the funicular cable assembly 32 and selecting a proportional scale of weights. This may be done at a convenient scale on a true wall by locating lines that represent the reinforcing webs 20'' that will connect to the funicular cable assembly 32. On the same wall on a horizontal line, it is then necessary to locate low friction pins that represent the pin centers of the funicular cable assembly. Over these pins you then string a light limp thread, leaving the center clear, and attach weights that are proportional to the acting header cable 28 loads to the hanging ends of the thread. Next, weights are attached to the thread, between the pins, that are similarly proportional to the loads in the webs 20'' that will attach to the funicular cable assembly 32. The location of the weights is then manipulated along the thread until they all overlay their respective reinforcement line. For accuracy it may be necessary to vibrate the wall and make a series of minor adjustments to the weights as well as to disturb the system both up and down to exorcise the effects of friction.

Next, you take measurements of all relevant points to determine cable length, angle of action and location of cable/reinforcement junctions on the canopy relative to a line between the pin centers. Results may be enhanced through calculation. The results, whether enhanced or not, may then be used to complete patterning of cloth for the canopy and strength sizing of the harness system components using appropriate safety factors. If patterning and sizing are unsatisfactory for aesthetic, economic or other reasons, the weight hanging may be redone using wider or narrower pin centers and varying load proportions as necessary.

The end result is an air structure incorporating a novel funicular polygon assembly 32 of the type described. This assembly 32 has, because of its force formed nature, the special ability to hold the structure in static equilibrium and also to widely redistribute local dynamic loads as they are imparted.

Figure 7:
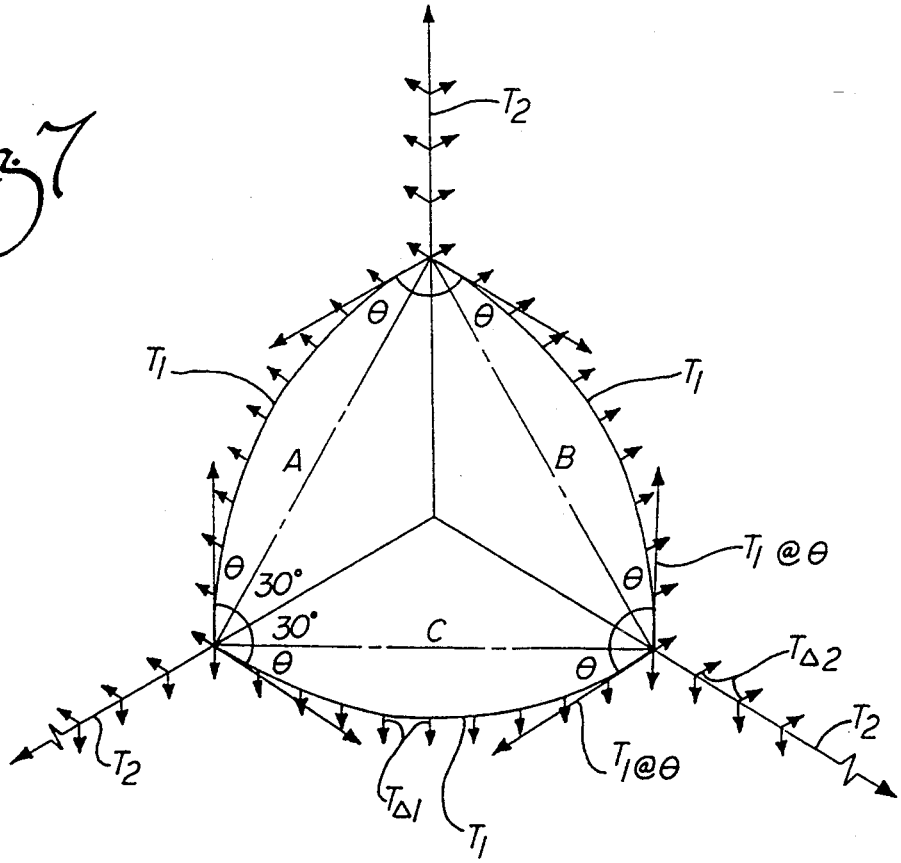
FIG. 7 is a force diagram for a funicular polygon assembly of the type employed in an equilateral triangular air structure of the present invention of the type shown in FIG. 2 in static equilibrium under inflation pressure only.
Figure 8:
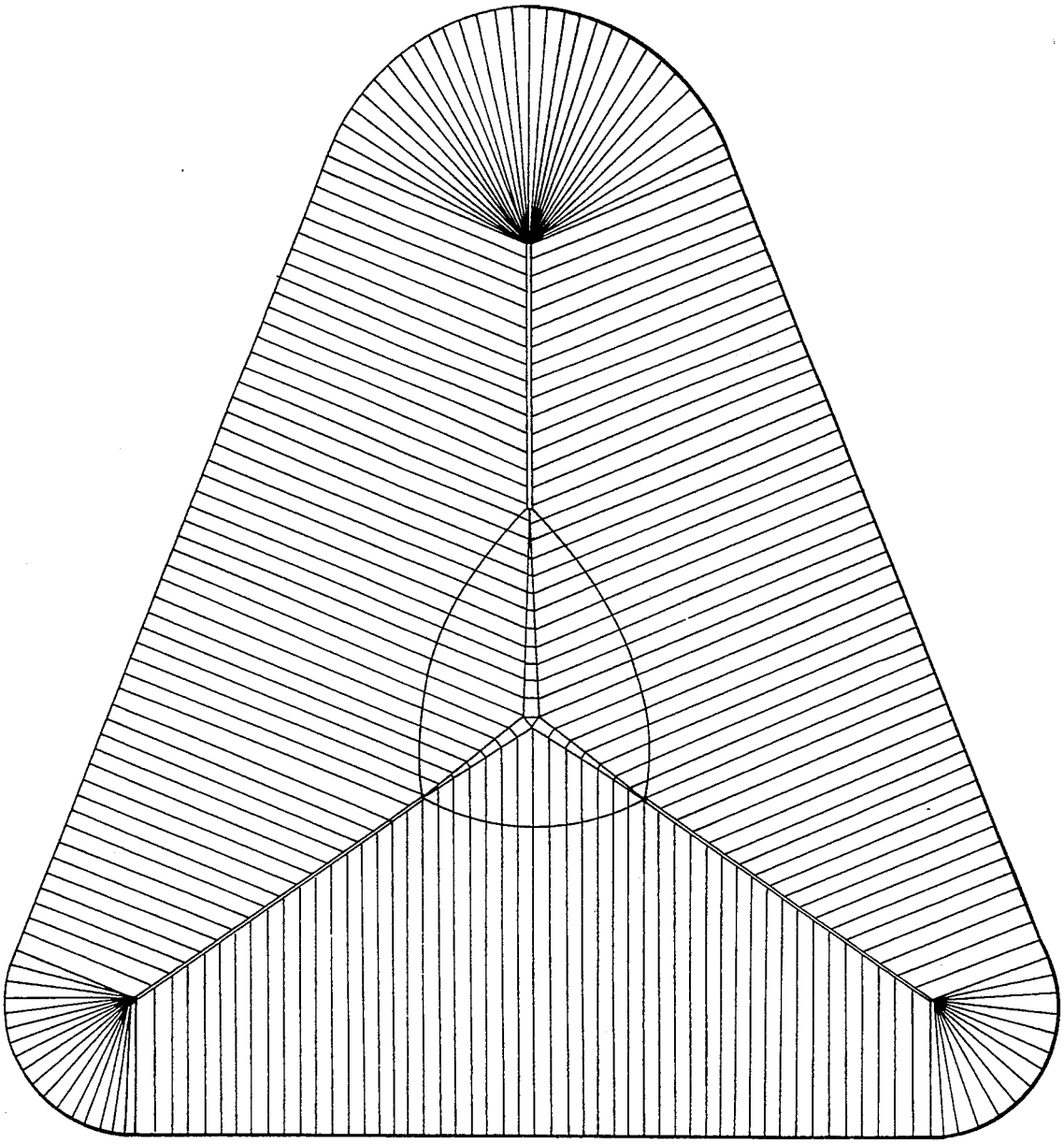
FIG. 8 is a top plan view of an isosceles triangular shaped air supported structure constructed in accordance with the teachings of the present invention.
Figure 9:
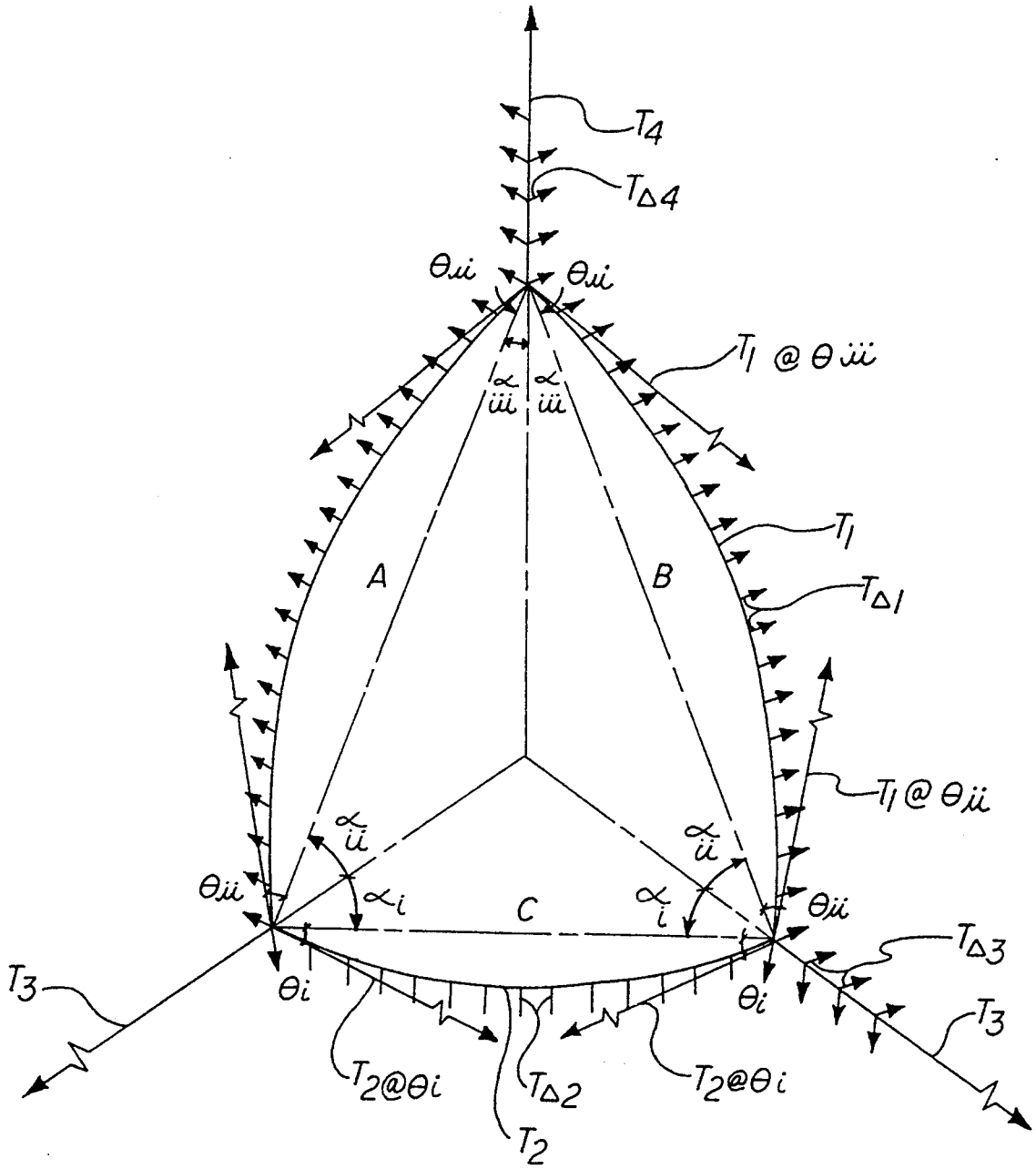
FIG. 9 is a force diagram for a funicular polygon assembly of the type employed in an isosceles triangular air structure of the present invention of the type shown in FIG. 8 in static equilibrium under inflation pressure only.

Specific illustration of the unique advantages provided by the present structure may be had by reference to FIGS. 7–10. FIGS. 7 and 9 are force diagrams, in the abstract, of the forces that define the form of two representative funicular polygon assemblies. FIG. 7 relates to the sort of assembly employed in an equilateral triangular air structure as shown in FIG. 2 in static equilibrium under inflation pressure only. FIG. 9 relates to the sort of assembly employed is an isosceles, triangular air structure as shown in FIG. 8, also in equilibrium.

In FIG. 7:

$T_1$=Tension in the ring cables, resulting from $T\Delta_1$ $T_2$=Tension at the top of the header cables resulting from the summation of the cosine forces in $T\Delta_2$ and the forces from the fan plates $T\Delta_1$=Tension at the connection of the reinforcements to the ring cables, varies with panel radius $T\Delta_2$=Tension at the connection of the reinforcements to the header cables, varies with panel radius.

Imaginary lines A, B, and C join the intersections of the centerlines of the ring and header cable assemblies.

Then equilibrium is established when;

$$T_1\,(\theta^{sin})=(\Sigma\, T\Delta_1)/2 \text{ or } T_1=8\,(\Sigma T\Delta_1)/2\,/\,\theta^{sin} \qquad Eq.\ 1$$

$$T_1\,(\theta+30°)^{cos}=T_2/2 \qquad Eq.\ 2$$

In FIG. 9:

$T_1$=Tension in ring cables A and B, resulting from forces $T\Delta_1$ $T_2$=Tension in ring cable C, resulting from forces $T\Delta_2$ $T_3$=Tension at the top of header cables going to points AC and BC, resulting from the summation of the cosine vectors of the forces $T\Delta_3$ plus the forces from the fan plates at header cable base.

$T_4$=Tension at the top of the header cables going to point AB, resulting, like $T_3$, from the forces $T\Delta_4$ and fan plate.

$T\Delta_1$=Tension at the connection of reinforcements to ring cable A and B, varies with panel radius $T\Delta_3$=Tension at the connection of reinforcements to ring cable C, varies with panel radius $T\Delta_4$=Tension at the connection of reinforcements to header cables going to points AC and AB, varies.

$T\Delta_4$=Tension at the connection of reinforcements to header cables going to point AB.

Imaginary lines A, B, and C join the intersections of the centerlines of the ring and header cable assemblies and are perpendicular, for A and B, to the force lines $T\Delta_1$ and for C, to the force lines $T\Delta_2$.

$$T_1\,(\theta_{iii}^{sin})=(\Sigma T\Delta_1)/2 \text{ or } T_1=[(\Sigma T\Delta_1)/2]\,/\,\theta_{iii}^{sin} \qquad Eq.\ 1$$

$$T_2\,(\theta_i^{sin})=(\Sigma T\Delta_2)/2 \text{ or } T_2=[(\Sigma T\Delta_2)/2\,]\,/\,\theta_i^{sin} \qquad Eq.\ 2$$

$$T_3=[T_2(\theta_i+\alpha_i)^{cos}]+[T_1(\theta_{ii}+\alpha_{ii})^{cos}] \qquad Eq.\ 3$$

$$T_4=[T_1(\theta_{iii}+\alpha_{iii})^{cos}]\ X\,2 \qquad Eq.\ 4$$

Figure 10:
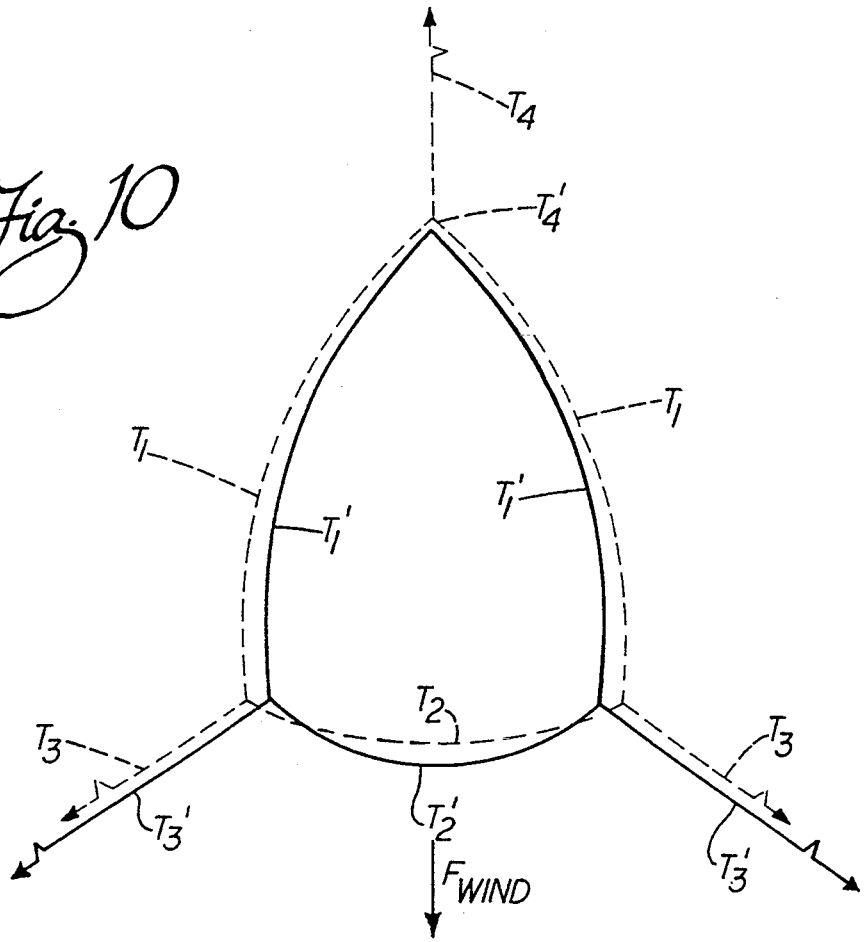
FIG. 10 is a force diagram providing an exaggerated showing of how the funicular polygon assembly of the present invention generally distributes and resists local loading.

The dashed lines $T_1$ to $T_4$ in FIG. 10 represent the location of the ring and header cables 32, 38 of an isosceles structure in static equilibrium, under inflation pressure as in FIG. 9. The solid lines $T_1'$ to $T_4'$ represent the shape and location that the ring and header cables 32, 38 assume in response to an idealized wind suction load, F wind.

Funicular ring cable, $T_2'$ becomes more deeply accurate in response to increased loading from the canopy reinforcements ($T\Delta_2$, FIG. 9), resulting from wind suction. In becoming more deeply arcuate and because its ends are restrained, in dynamic equilibrium, by the forces in $T_1'$ and $T_3'$ the geometry of and forces in these elements are affected. The ring cables $T_1$ are flattened and swung inward toward the apex. This serves to increase the tension and proportion of resistance carried by the windward (impact) reinforcements ($T\Delta_1$, FIG. 9).

Simultaneously, the slight displacement in the direction of the wind, of the header cables, $T_3'$ and ring cable $T_2'$ serves to relax the tension in the leeward (suction) reinforcements, which decreases the pneumatic radius of the canopy and therefore decreases the rate at which the given, additive, suction and inflation loads generate forces in the leeward reinforcements.

The combined effect of windward tensioning and leeward relaxation serves to increase resistance to deflection as the deflection increases. This stabilization effect is in addition to the stabilizing response of general structural distortion seen in prior art air structures.

In contrast, the cable assemblies in the prior art are radially defined, or circular in structure and are not dynamically active outside of general structural distortion. The funicular polygon assembly of the present invention, however, functions in a novel manner serving to link together all elements of the harness system so that local loading is generally distributed and resisted. FIG. 10 is an exaggerated diagram of this action.

In summary, numerous benefits result from employing the concepts of the present invention. The unique structure, including the funicular cable assembly 32, of the air supported structure 10 of the present invention serves to provide an equilibrium/load-sharing system that reacts to the application of wind loads to provide counterbalance and self-correcting load support thereby improving the strength, stability and durability of the structure. The design also allows for relatively vertical side walls 12 which significantly enhanced the usefulness of the space within the air structure 10 particularly next to the side walls by increasing the overhead clearance. Additionally, the air structure 10 includes a bubble dome apex A that collects heat for transfer through a single membrane wall portion 52 provided in the apex. The transferred heat serves to melt snow, which then slides freely from the steeply sloped walls of the apex to the main wall of the air supported structure. Advantageously, the sliding action of the snow from the apex serves to also shed snow from the main wall thereby substantially avoiding the problems associated with excessive snow build-up.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An air supported structure for anchoring to the ground, comprising:

a wall portion, formed from a plurality of panel members joined together by seam means, including an apex;

means for reinforcing said seam means interconnected along said seam means;

a plurality of header cable means for carrying loads placed on said structure;

crown harness means extending along said apex;

funicular cable means including first and second cable strands with two degrees of curvature forming inner and outer funicular polygon rings extending peripherally about said apex for balancing static loads and for redistributing dynamic loads placed on said structure;

means for joining said first and second cable strands with a terminus of each of said plurality of header cable means;

means for connecting said reinforcing means to said first and second cable strands; and means for anchoring said structure to the ground.

2. The air supported structure set forth in claim 1, wherein adjacent reinforcing means are alternately connected to said first strand and said second strand.

3. The air supported structure set forth in claim 2, wherein said reinforcing means connected to said first and second strands also extend between and are connected to said anchoring means and said crown harness means.

4. The air supported structure set forth in claim 3, further including a corner support assembly at each corner of said structure.

5. The air supported structure set forth in claim 4, wherein said plurality of header cable means are connected at one end to one of said corner support assemblies and at a second end to said funicular cable means.

6. The air supported structure set forth in claim 4, wherein each corner support assembly includes a corner fan plate and a radially arrayed series of reinforcing means extending about an arc of between 36° and 120°.

7. The air supported structure set forth in claim 1, wherein said apex of said wall portion includes a relatively thin membrane portion for transferring heat and clamp means for attaching said thin membrane portion to said wall portion.

8. An air supported structure for anchoring to the ground, comprising:

a wall portion, formed from a plurality of panel members joined together by seams, including an equal plurality of sides and corners and including an apex;

means for reinforcing said seams, said reinforcing means being interconnected along said seams;

a plurality of corner support assemblies, one for each corner of said structure;

a plurality of header cable means for gathering loads placed on said structure, said plurality of header cable means being connected to said reinforcing means through connections therebetween whereby loads accumulating in said reinforcing means are transferred to said header cable means through said connections, each of said header cable means further including a first end connected to one of said corner support assemblies and a second, opposite end;

funicular cable means for balancing static loads and redistributing dynamic loads placed on said structure, said funicular cable means being connected to and interconnecting said second ends of said plurality of header cable means and said funicular cable means extending with two degrees of curvature in a continuously funicular path across and connecting to said reinforcing means so as to constitute a continuous funicular ring about a periphery defining said apex; and means for anchoring said structure to the ground.

9. The air supported structure set forth in claim 8, wherein said apex further includes a crown harness, said crown harness being connected to reinforcing means extending along said apex.

10. The air supported structure set forth in claim 8, wherein said funicular cable means includes first and second cable strands forming inner and outer continuous funicular rings about said periphery defining said apex.

11. The air supported structure set forth in claim 9, wherein said funicular cable means includes first and second cable strands forming inner and outer continuous funicular rings about said periphery defining said apex.

12. The air supported structure set forth in claim 11, wherein means are provided for joining said first and second cable strands to said second end of each of said plurality of header cable means.

13. The air supported structure set forth in claim 12, wherein adjacent reinforcing means are alternately connected to said first cable strand and said second cable strand.

14. The air supported structure set forth in claim 8, wherein said apex of said wall portion includes a relatively thin membrane portion for transferring heat and clamp means for attaching said thin membrane portion to said wall portion.

* * * * *